US006474408B1

(12) United States Patent
Yeh et al.

(10) Patent No.: US 6,474,408 B1
(45) Date of Patent: Nov. 5, 2002

(54) HEAT EXCHANGER WITH BYPASS SEAL ALLOWING DIFFERENTIAL THERMAL EXPANSION

(75) Inventors: Edward Yuhung Yeh, Rancho Palos Verdes, CA (US); Steven Ayres, Redondo Beach, CA (US); David W. Beddome, San Pedro, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/652,949

(22) Filed: Aug. 31, 2000

(51) Int. Cl.[7] ..... F28F 7/00
(52) U.S. Cl. ..... 165/82; 165/81
(58) Field of Search ..... 165/158, 159, 165/81, 82, 83, 166

(56) References Cited

U.S. PATENT DOCUMENTS 3,818,984 A * 6/1974 Nakamura et al. ..... 165/166
3,870,099 A * 3/1975 Wolowodiuk ..... 165/82
3,889,744 A * 6/1975 Hill et al. ..... 165/83
3,907,457 A * 9/1975 Nakamura et al. ..... 415/112
4,434,840 A * 3/1984 Porowski et al. ..... 165/82
4,583,584 A * 4/1986 Wepfer ..... 165/82
4,596,285 A 6/1986 Dinulescu
4,733,722 A * 3/1988 Forbes et al. ..... 165/159
4,735,260 A 4/1988 Wohrl et al.
4,776,387 A * 10/1988 Newman ..... 165/82
4,921,680 A * 5/1990 Bonk et al. ..... 422/197
5,065,816 A * 11/1991 Darragh ..... 165/82
5,094,290 A 3/1992 Buckreus

* cited by examiner

*Primary Examiner*—Henry Bennett
*Assistant Examiner*—Terrell McKinnon
(74) *Attorney, Agent, or Firm*—Ephraim Starr; Felix Fischer

(57) ABSTRACT

The present invention is embodied in a heat exchanger, which allows differential thermal expansion of its elements while providing a bypass seal. In at least one embodiment, the heat exchanger includes, a shell for containing a first gas, a core positioned within the shell, and a seal positioned between the core and the shell. The seal allows at least some differential expansion between the shell and the core while restricting the flow of the first gas past the seal. This allows a space for expansion of the core to exist between the core and the shell, while preventing the first gas from bypassing the core by traveling through the expansion space. As such, the seal forces the first gas to pass through the core, greatly increasing heat transfer from the first gas to the core. Preferably, the seal is mounted to the core at a position at least adjacent to the free (moveable) end or ends of the core. The seal can be folded into several layers such that the folds abut both the core and the shell. When the core expands or contracts the seal is draw apart (unfolded) or compacted (further folded), as the case may be. In another embodiment, the seal is a single layer of material with sufficient slack between the core and the shell to allow the core to expand and contract separately from the shell.

18 Claims, 7 Drawing Sheets

HEAT EXCHANGER WITH BYPASS SEAL ALLOWING DIFFERENTIAL THERMAL EXPANSION

BACKGROUND OF THE INVENTION

1. Field of the Invention

To improve the overall efficiency of a gas turbine engine, a heat exchanger or recuperator can be used to provide heated air for the turbine intake. The heat exchanger operates to transfer heat from the hot exhaust of the turbine engine to the air being drawn into the turbine. As such, the turbine saves fuel it would otherwise expend raising the temperature of the intake air to the combustion temperature.

The heat of the exhaust is transferred, by ducting the hot exhaust gases past the cooler intake air. Typically, the exhaust and intake ducting share multiple common walls, or other structures, to allow the heat to transfer between the ducts. That is, as the exhaust gases pass through the ducts they heat the common walls, which in turn heat the intake air passing on the other side of the walls. Generally, the greater the surface areas of the common walls, the more heat which will transfer between the exhaust and intake air.

2. Description of the Related Art

As shown in the cross-sectional view of FIG. 1, one example of this type of prior art heat exchanger uses a shell assembly 10 to contain and direct the exhaust gases, and a core assembly 20 placed within the shell assembly to contain and direct the intake air. As can be seen, the core assembly 20 is constructed of a stack of thin plates 22 which alternatively channel the inlet air and the exhaust gases through the core 20. That is, the layers 24 of the core 20 alternate between ducting the inlet air and ducting the exhaust gases. In so doing, the ducting keeps the air and exhaust gases from mixing with one another. Generally, to maximize the total heat transfer surface area of the core 20, many closely spaced plates 22 are used to define a multitude of layers 24. Further, each plate 22 is very thin and made of a material with good heat conducting properties. Keeping the plates 22 thin assists in the heat transfer between the hot exhaust gases and the colder inlet air.

The core 20 is contained in the shell assembly 10. Because the shell assembly 10 needs to support the core and is not a heat transfer medium, the shell 10 is typically made of a much thicker material than that of the core 20. Unfortunately, this greater thickness causes the shell assembly 10 to thermally expand at a much slower rate than the quick responding core 20 with its thin plates 22.

With the core 20 held within the shell assembly 10, the loads created by the differential expansion between the core 20 and shell 10 can cause fatigue failures and creep over time. Fatigue and creep can be especially problematic when heat exchangers are repeatedly cycled between hot and cold stages. Depending on their specific use, such turbines can be started, ran-up and shutdown over and over. One example of such cyclic use, is turbines employed in the production of electric power, which are ran only during recurring periods of peak power demand.

An additional problem is the potential for the exhaust gas to bypass the core, instead of traveling through the core. If allowed, some, if not most, of the exhaust gas will divert around an end or the sides of the core. Even a small gap existing between the core and the shell can allow a great deal of exhaust gas to bypass the core. Of course, when the exhaust gas bypasses the core, the rate of heat transfer is lowered, and as a result, the overall efficiency of the turbine and recuperator system drops dramatically.

Therefore, a need exists for a heat exchanger, which allows for differential thermal expansion between the core and the shell assembly, while at the same time maximizing the heat transfer efficiency of the exchanger by preventing the exhaust gases from bypassing the core.

SUMMARY OF THE INVENTION

The present invention is embodied in an apparatus, which allows differential thermal expansion while preventing gas from bypassing the core. In at least one embodiment, the heat exchanger includes a shell for containing a first gas, a core positioned within the shell, and a seal positioned between the core and the shell. The seal allows at least some differential expansion between the shell and the core, while restricting the flow of the first gas past the seal. The seal provides a sealed expansion space to exist between the core and the shell. The seal prevents the first gas from bypassing the core by passing through the expansion space. As such, the seal forces the first gas to pass through the core. This greatly increases the heat transfer from the first gas to the core. Preferably, the seal is mounted to the core at a position at least adjacent to the free (moveable) end of the core and about the expansion space.

In one embodiment, the seal is one or more flexible sheets of material at least partially folded to allow for the differential expansion. The seal includes a first end, a second end and fold(s), positioned between the ends. In one embodiment, one or more folds of the material abut against the shell and/or the core to form a seal. Preferably, the material is layered, being folded over at the ends of the layers. The folds on one side of the seal abut the core and the folds on the opposing side of the seal abut the shell. In this embodiment, when the core expands or contracts relative to the shell, the seal is either partly drawn apart (unfolded) or further compacted, as the case may be. As the seal is drawn apart, sufficient material is kept folded between the core and the shell. This allows an acceptable seal to be maintained, preventing, or at least limiting, the first gas from bypassing the core.

In an another embodiment, the seal is one or more sheets of material, which are connected between the core and the seal, without layering by folding. In this embodiment, sufficient extra seal material is provided between the core and the shell to allow the core to expand and/or contract. That is, the seal has enough slack to allow the extra seal material to be taken up during expansion or contraction, as the case may be. Preferably, the seal of this embodiment uses just a single layer of material to substantially prevent the first gas from passing through the seal.

In an other embodiment of the invention, the heat exchanger includes: a shell for containing a first gas flowing through the shell; an expandable core positioned within the shell, where the core has a contracted length, an expanded length, a fixed end mounted to the shell, and a free end separate from the shell, so that the core may expand to the expanded length without being substantially restricted by the shell; an adjustable seal positioned between the core and the shell, where the seal restricts the flow of the first gas past the seal, where the seal is substantially contacting the core at least adjacent to the free end of the core, and where the seal is sufficiently adjustable to allow the core to expand and contract while restricting the flow of the first gas past the seal.

Although the seal can be used with a vast variety of core and shell configurations, it is preferred that the core is a set of plates which define alternating first and second gas layers. The core ducts the first gas from the shell through the core and back out to the shell. Also, the core ducts the second gas from an intake through the alternating second gas layers and out an outlet. This allows heat to transfer from one gas to the other. Preferably, the first gas is a relatively hot turbine exhaust gas (the turbine being connected at its intake and outlet to the heat exchanger) and the second gas is a relatively cool turbine inlet air.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION OF THE INVENTION

The present invention allows differential thermal expansion between the heat exchanger's core and shell assembly, preventing damage from fatigue failure and creep. Further, the invention provides a seal to prevent exhaust gases from bypassing the core. The present invention has several advantages over the prior art.

One advantage of at least one embodiment of the Applicants' invention is that by allowing the core to expand and contract freely from the shell, the core is not placed under loads caused by the shell restricting the movement of the core. As such, the embodiment avoids the fatigue failure and creep problems associated with prior art heat exchangers. Because the core is not under the compressive loads, which exist when the core is restrained by the shell during expansion, the pre-load placed on the core can be dramatically reduced. In addition, since the shell assembly is not required to carry the loads generated by core expansion, the shell requires less structure. This allows the shell to be simpler and less expensive to manufacture, as well as significantly lighter.

Another advantage of at least one embodiment of the present invention is that by providing a seal between the expandable core and shell, the exhaust gases are not allowed to bypass the core. The efficiency of the heat exchanger is maximized since all of the hot exhaust gas is directed through the core to heat the intake air. Further, because the seal is adjustable, the seal continues to prevent gas from bypassing the core even while the core expands and contracts. Also, because the apparatus simply uses a sheet of flexible material for the seal, the device is kept relatively durable, inexpensive, easy to manufacture and form about various shapes. Because the seal is a ceramic material, the seal is also highly resistive to corrosion.

Figure 1:
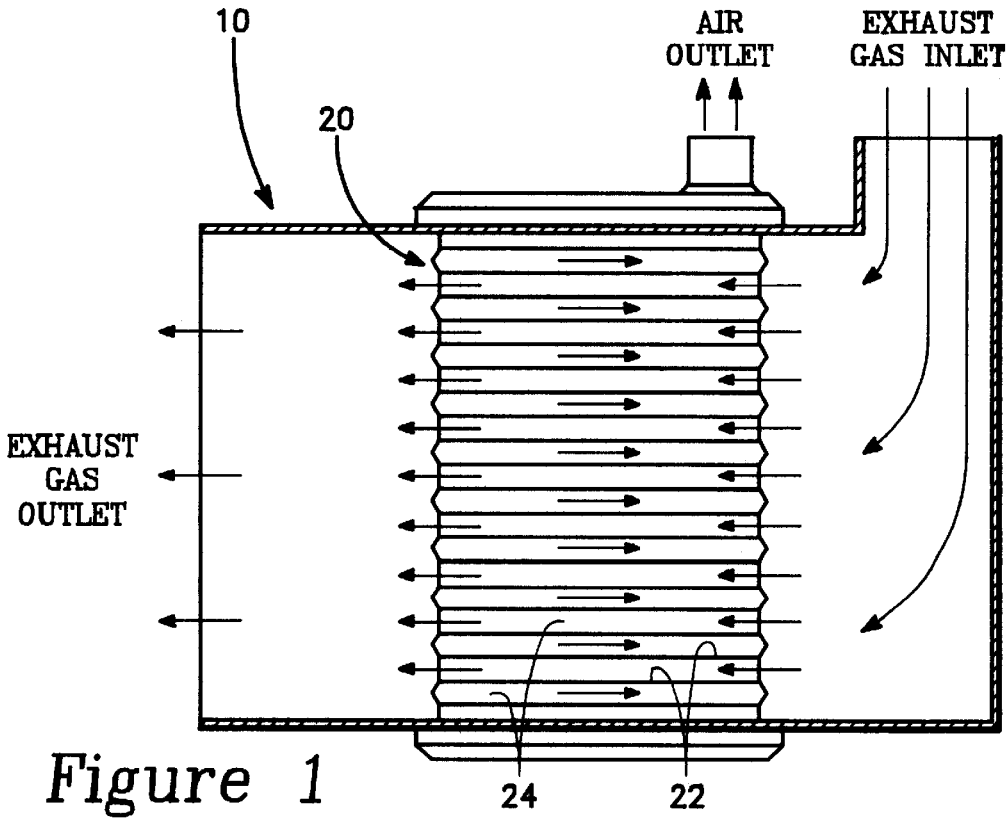
FIG. 1 is a side cross-section of a heat exchanger.
Figure 2:
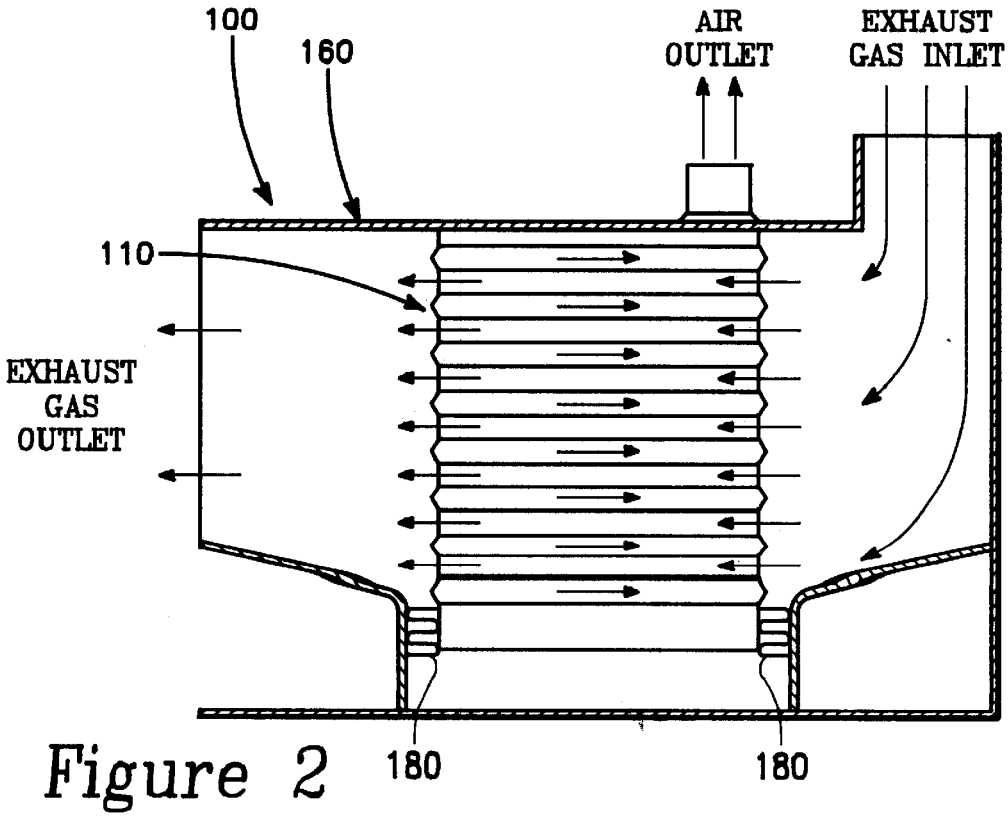
FIG. 2 is a side cross-section of a heat exchanger in accordance with an embodiment of the present invention.

As shown in FIG. 2, one embodiment of the Applicants' invention is a heat exchanger 100 having a seal 180 positioned between a core 110 and a shell assembly 160.

The core 110 is positioned within the shell 160. The core 110 functions to duct the inlet air past the exhaust gas so that the heat of the exhaust gas can be transferred to the cooler inlet air. The core 110 performs this function while keeping the inlet air separated from the exhaust gas, such that there is no mixing of the air and the gas. Keeping the air and gas separate is critical, as the mixing of the two will result in reduced efficiency, and potentially in a reduction in the engine performance.

Figure 3:
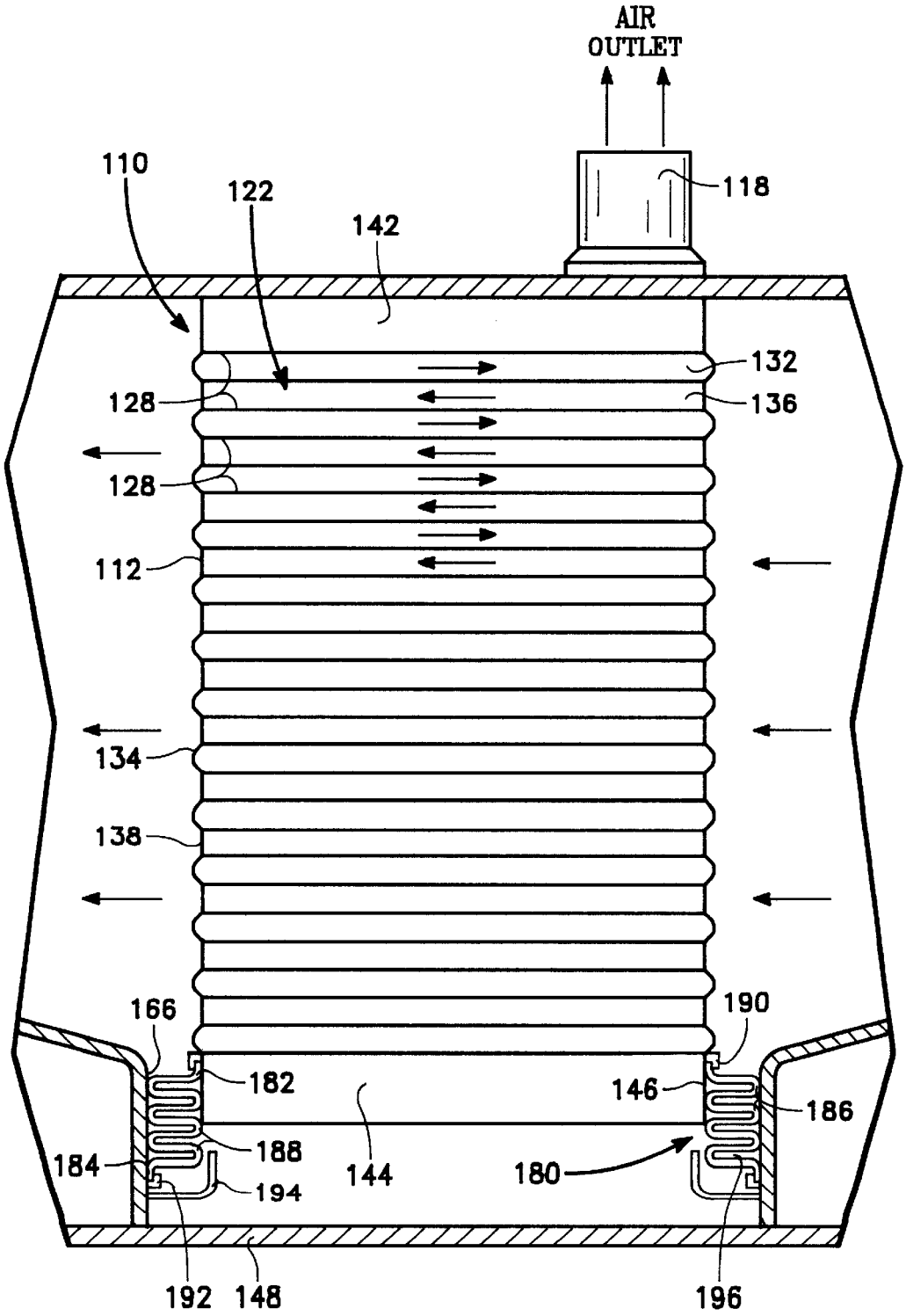
FIG. 3 is a side cross-section of a heat exchanger in accordance with an embodiment of the present invention.
Figure 4:
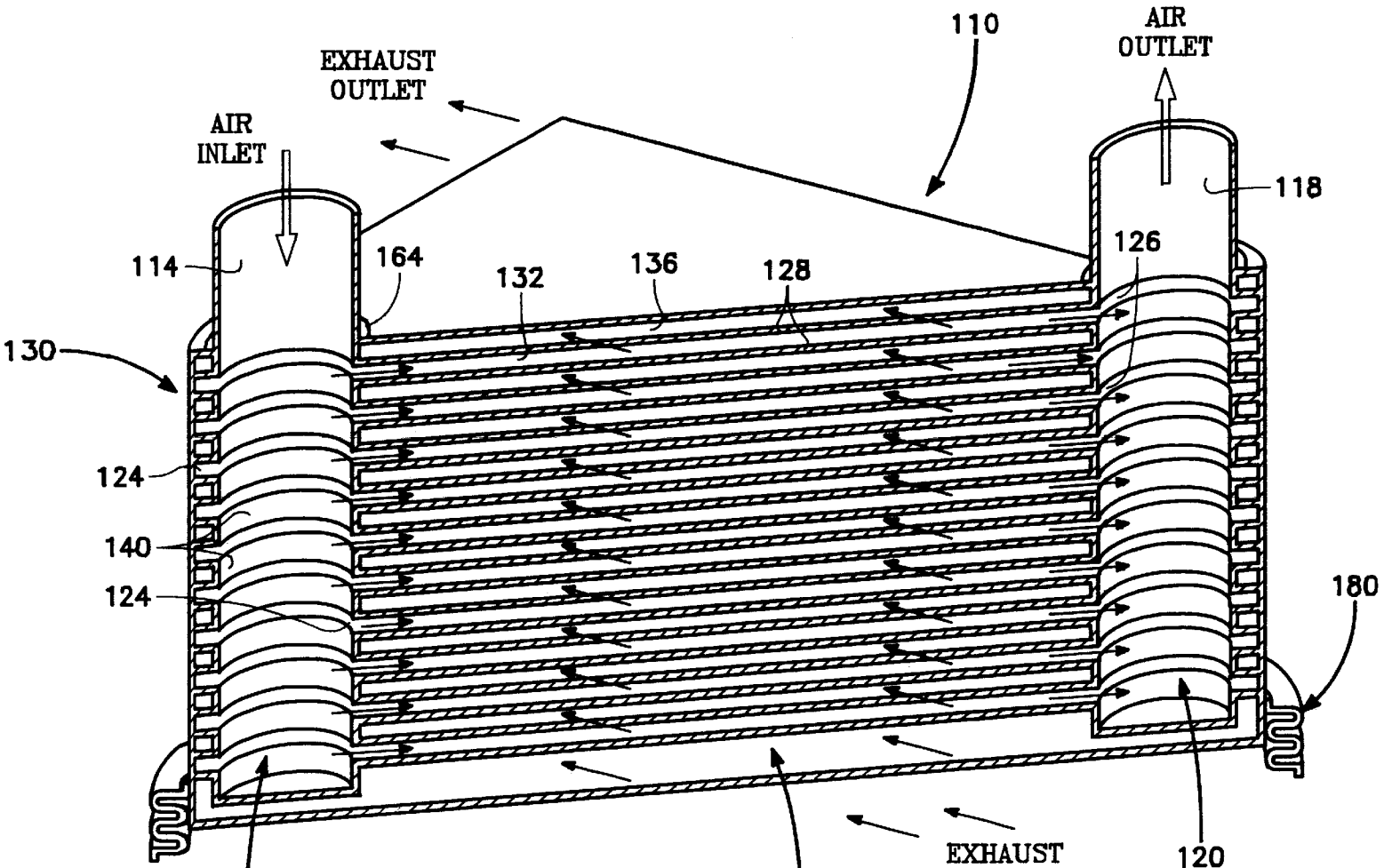
FIG. 4 is an isometric view of a cross-section of a heat exchanger in accordance with an embodiment of the present invention.

As shown in FIGS. 3 and 4, the core 110 has an exterior surface 112, an air in duct or tube 114 (FIG. 4 only) and an air out duct or tube 118. The air in duct 114 receives relatively cool inlet air and ducts it into the core 110. The air out duct 118 receives the inlet air after it has been heated in the core 110 and ducts the air out of the core 110. Between the air in duct 114 and the air out duct 118 is a heat exchange region 122.

The heat exchange region 122 can be any of a variety of configurations which allow heat to transfer from the exhaust gas to the inlet air while keeping the gases separate. However, it is preferred that the heat exchange region 122 be a prime surface heat exchanger having a series of layered plates 128, which form a stack 130. The plates 128 are set to define layers 132 and 136 which alternate from ducting inlet air, in the air layers 132, to ducting exhaust gases, in the exhaust layers 136. These layers typically alternate in the core 110 (e.g. air layer 132, gas layer 136, air layer 132, gas layer 136, etc.). Separating each layer 132 and 136 is a plate 128.

As can be seen, the plates 128 are generally aligned with the flow of the exhaust gas through the shell assembly 160. The plates 128 can be made of any well known suitable material, such as steel or aluminum, but preferably are made of a stainless steel. The plates 128 are stacked and connected (e.g. welded or brazed) together in an arrangement such that the air layers 132 are closed at their ends 134. With the air layers 132 closed at ends 134, the core 110 retains the inlet air as it passes through the core 110. The air layers 132 are, however, open at air layer intakes 124 and air layer outputs 126. As shown in FIG. 4, the air layer intakes 124 are connected to the air in duct 114, so that air can flow from the duct 114 into each air layer 132. Likewise, the air layer outputs 126 are connected to the air out duct 118 to allow heated air to flow to the duct 118 from the air layer 132.

In contrast to the air layers 132, the gas layers 136 of the stack 130 are open on each end 138 to allow exhaust gases to flow through the core 110. Further, the gas layers 136 have closed or sealed regions 140 located where the layers 136 meet both the air in duct 114 and the air out duct 118. These closed regions 140 prevent air, from either the in duct 114 or out duct 118, flowing out of the core via the gas layers 136.

Therefore, as shown in FIGS. 3 and 4, the intake air is preferably brought into the core 110 via the air in duct 114, distributed along the stack 130 by passing through the in tube 116, passed through the series of air layer intakes 124 into the air layers 132, passed through the air layers 132 such that the air flows adjacent (separated by plates 128) to the flow of the exhaust gas in the gas layers 136, passed out of the air layer 132 at the air layer outputs 126 into the out tube 120, and finally passed out of the core 110 through the air out duct 118. As the air passes through the core 110 heat is transferred to it from the exhaust gas.

With the stack arranged as shown in FIGS. 2–4, the hot exhaust gas passes through the core 110 at each of the gas layers 136. In so doing, the exhaust gas heats the plates 128 positioned at the top and bottom of each gas layer 136. The heated plates 128 then, on the opposite sides, heat the inlet air passing through the air layers 132.

Figure 5A:
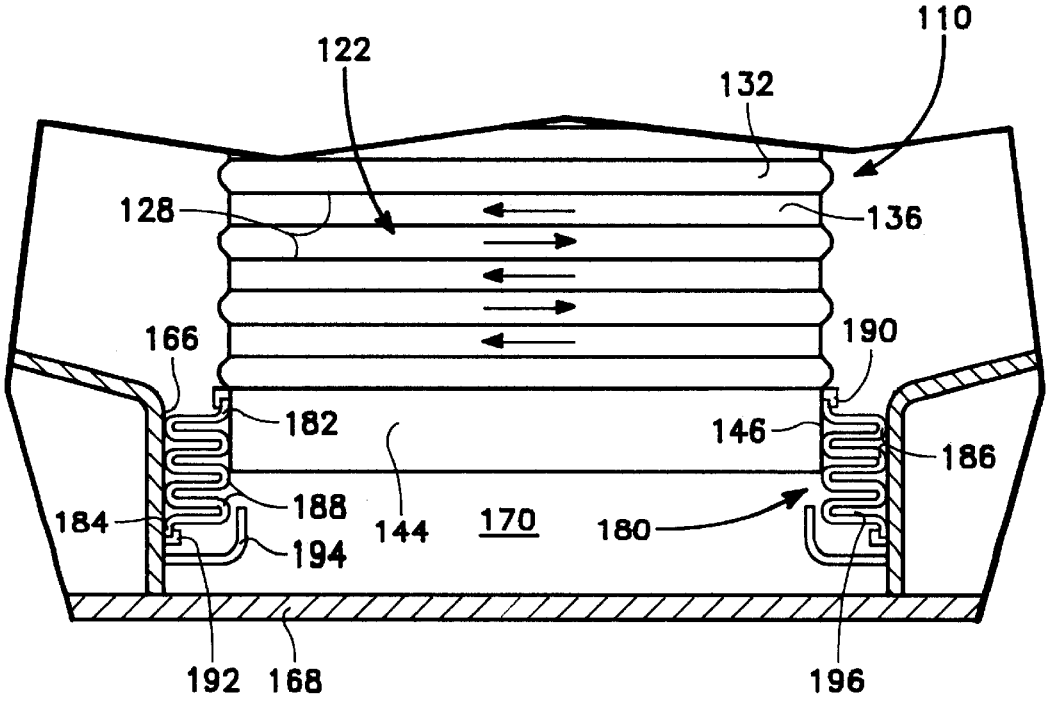
FIGS. 5*a* and *b* are side cross-sections of a heat exchanger in accordance with an embodiment of the present invention.
Figure 5B:
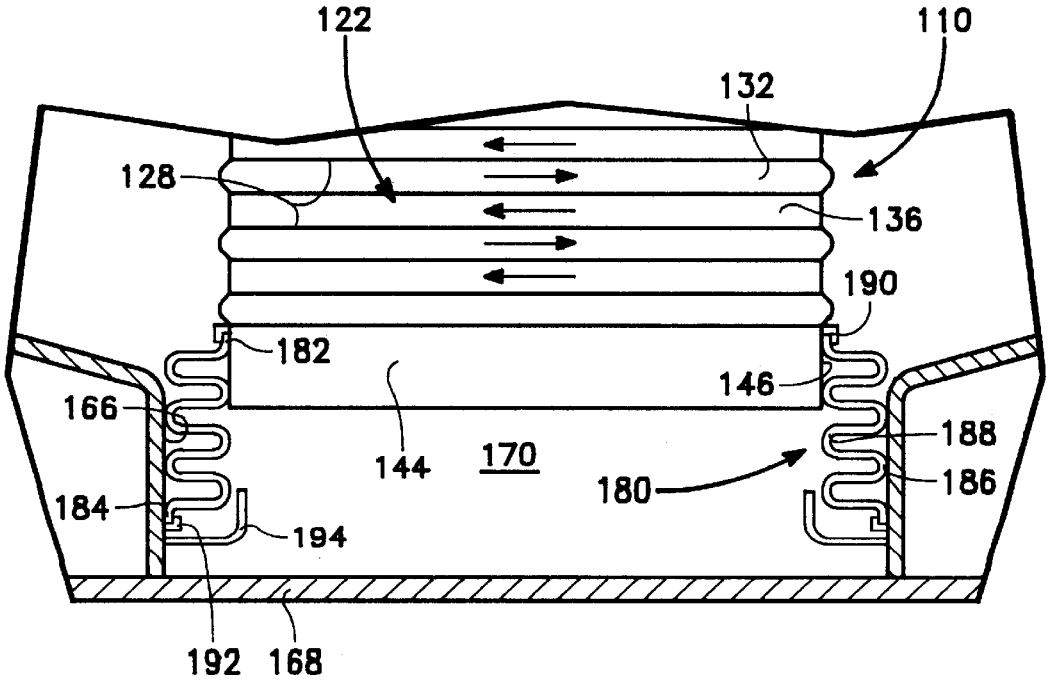

As the plates 128 and the connected structure of the core 110 heat up, they expand. This results in an expansion of the entire stack 130 and thus of the core 110. As noted, this expansion is faster than the expansion of the shell 160. The core 110 as expanded by heating is shown in FIG. 5*a*. Likewise, as the plates 128 reduce in temperature and the structure and the plates 128 contract, the overall length of stack 130 and core 110 will reduce. The core 110 as contracted is shown in FIG. 5*b*.

Although the core 110 can be arranged to allow the inlet air to flow through it in any of a variety of ways, it is preferred that the air is channeled so that it generally flows in a direction opposite, or counter, to that of the flow of the exhaust gas in the gas layers 136. With the air flowing in an opposite direction to the direction of the flow of the exhaust gas, it has been found by the Applicants that the efficiency of the heat exchanger is significantly increased.

The core 110 also preferably includes a first end plate 142 and a second end plate 144 located on either end of the stack 130. The first end plate 142 is mounted to the shell assembly 160 and the second end plate 144 is free (relative to the shell 160) to allow the core 110 to expand and contract. The second end plate 144 has sides 146.

Figure 6:
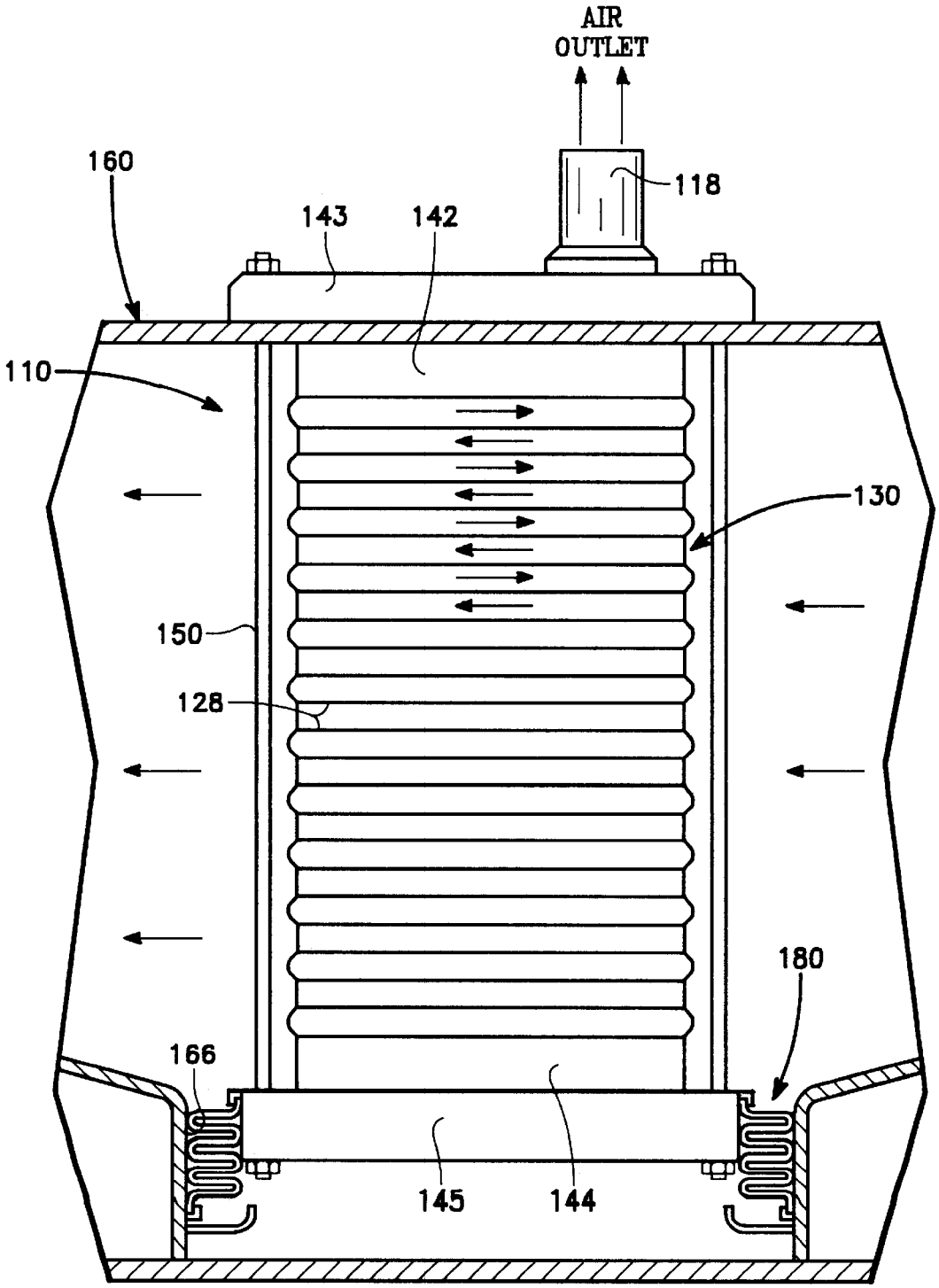
FIG. 6 is a side cross-section of a heat exchanger in accordance with an embodiment of the present invention.

As shown in FIG. 6, depending on the specific needs (e.g. pre-loads, forces exerted on the stack 130, compression of the plates 128 of the stack 130, and the like) of the use of the heat exchanger of present invention, a series of tie rods 150 can be used to hold together the stack 130 and carry loads. The tie rods 150 are attached at strongbacks 143 and 145 and carry forces from a variety of sources including: pressurization of the inlet air in the core 110, compression of the stack 130, and thermal expansion of the core 110. However, to minimize the structure of the tie rods 150 and strongbacks 143 and 145, it is preferred that the tie rods 150 allow the core 110 to thermally expand relatively freely. This can be done by sizing the rods or choosing a material, which allows the rods 150 to expand and contract, substantially with the core 110. By allowing the core 110 to freely expand and contract, an added benefit of reducing the pre-loads typically placed upon the core 110 by the tie rods 150, is obtained.

The arrangement of the core 110 can be any of a variety of alternative configurations. The air layers 132 and gas layers 136 do not have to be in alternating layers, instead they can be in any arrangement, which allows for the exchange of heat between the two layers. For example, the air layers 132 can be defined by a series of tubes or ducts running between the inlet duct 114 and the outlet duct 118, while the gas layers 136 are defined by the space outside of, or about, these tubes or ducts. The heating of the core 110 and shell 160 will still result in differential expansion between the elements in such a heat exchanger. Therefore, a seal 180 is utilized to allow the expansion of the core 110 to occur without allowing the exhaust gas to bypass the core 110. The core 110 can also include secondary surfaces such as fins or thin plates connected to the inlet air side of the plates 128 and/or to the exhaust gas side of the plates 128. The core 110 and shell 160 can carry various gases, other than, or in addition to, those mentioned above. Also, the core 110 and shell 160 can carry any of a variety of fluids.

The shell assembly 160 functions to receive the hot exhaust gases, channel them through the core 110, and eventually direct them out of the shell 160. The shell 160 is relatively air tight to prevent the exhaust gases from escaping, or otherwise leaking out of, the shell 160. The shell 160 is large enough to contain the core 110 and provide sufficient room to allow for a substantially unrestricted thermal expansion of the core 110. The amount of space within the shell 160 needed for the expansion of the core 110, will depend on the specific design, size and materials of the core 110, as well as on the properties of the inlet air and exhaust (e.g. temperatures, pressures, and the like). Of course, the specific amount of space required in the shell 160 to accommodate the thermal expansion of the core 110, can be determined by one skilled in the art using well known analytical and/or empirical methods.

Figure 7:
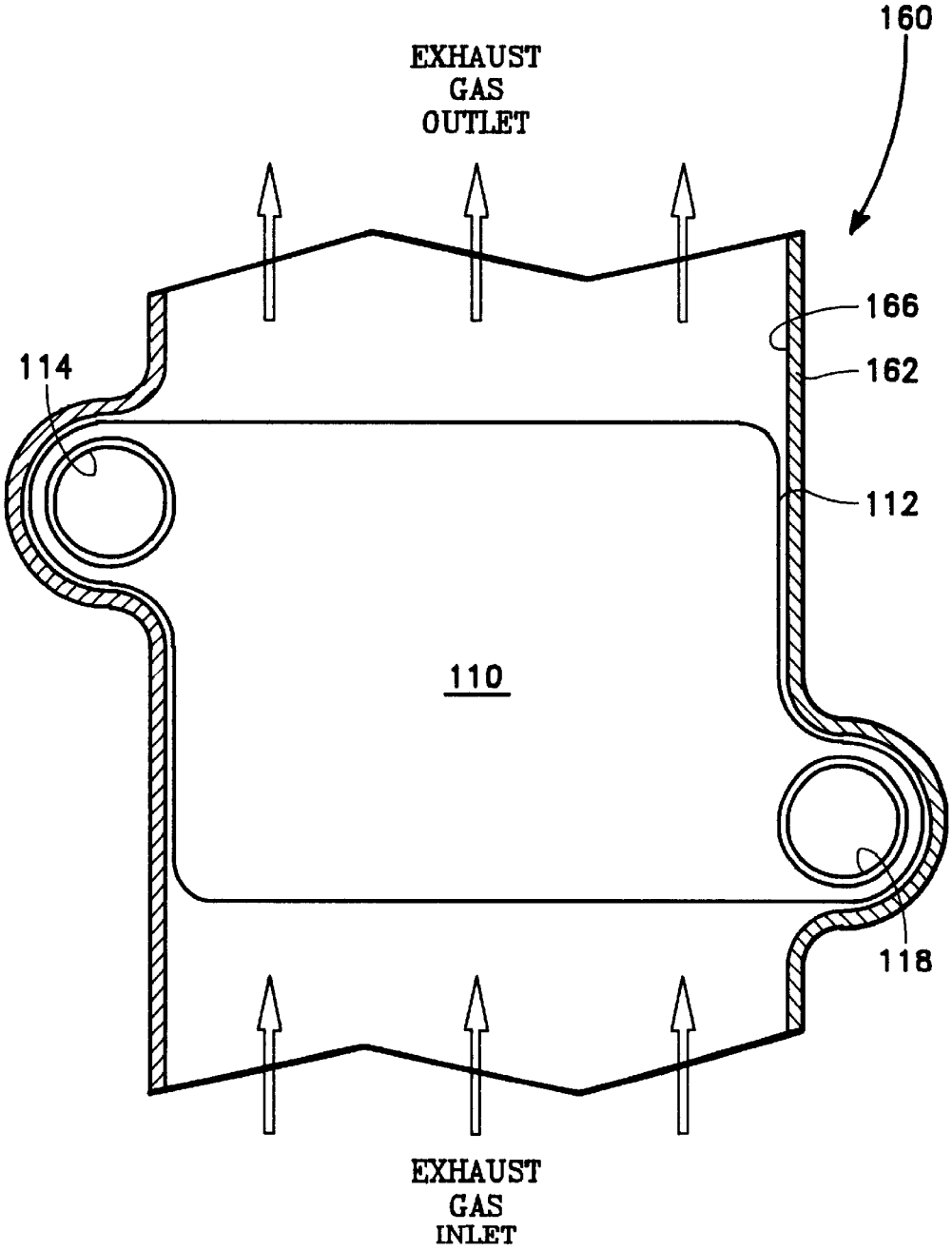
FIG. 7 is a top cross-section of a heat exchanger in accordance with an embodiment of the present invention.

The shell 160 also has openings 164 for the air in duct 114 and the air out duct 118 of the core 110. Further, the shell 160 has an interior surface 166. To prevent, or extremely limit, exhaust gas from passing around the sides of the core 110, the interior surface 166 of the shell assembly 160 is in contact with, or at least fits closely to, the sides 112 of the core 110. This is shown in FIG. 7. The shell assembly 160 can be made of any suitable well known material including, but not limited to, steel and aluminum. Preferably, the shell 160 is a stainless steel. In order to retain the pressure within the shell 160, the shell 160 also includes a plate or bottom 168, which is positioned across the end of the shell 160, as shown in FIGS. 2–5.

Because the shell assembly 160 can carry a variety of loads (both internally and externally exerted), and since the shell 160 does not need to transfer heat, its walls 162 are thick relative to the thin core plates 128. As previously noted, this greater thickness causes the shell 160 to thermally expand at a much slower rate than the core 110. This results in a significant amount of differential thermal expansion between the shell assembly 160 and the core 110 as the two are heated or cooled. The Applicants' present invention allows for this differential thermal expansion by allowing enough expansion room between the core and shell. Further, the invention prevents, or at least limiting, exhaust gas bypass through the expansion area by placing the flexible seal 180 between the core 110 and the shell assembly 160 and about the expansion area. The seal 180 can be any of a variety of embodiments.

As shown in FIG. 3, in at least one embodiment of the Applicants' invention, the seal 180 is a folded sheet of material set between the core 110 and the shell assembly 160. The seal 180 is positioned about the entirety of the core 110. The seal 180 has a first or core end 182, which is mounted to the core 100 and a second or shell end 184, which is attached to the shell assembly 160. The core end 182 and shell end 184 can be attached anywhere along the core 110 and shell 160, respectfully. However, it i s p referred that the seal 180 is positioned about the free end of the core 100.

Preferably, the seal is folded such that at least one exterior fold 186 contacts the interior surface 166 of the shell 160, and at least one of the interior folds 188 contacts the exterior surface 112 of the core 110. It is further preferred that at least some of the interior folds 188 contact the sides 146 of the second end plate 144. With the seal 180 contacting both the interior surface 166 and the exterior surface 112, the exhaust gas is prevented from flowing past the seal 180 and thus bypassing the core 110.

By folding the seal 180, the core 110 can expand and contract freely and separately from the shell 160. As shown in FIG. 5*b*, when the core 110 is contracted, the core 110 is shorter, and as such, the seal 180 has been extended, or drawn out, by the core 110. In contrast, when the core 110 has expanded, as shown in FIG. 5*a*, the seal 180 is compressed. Because, the seal 180 is folded over in this embodiment, the seal 180 continues to maintain contact with both the exterior surface 112 of the core 110 and the interior surface 166 of the shell 160. As such, the seal 180 prevents bypass of exhaust gases around the core 110, whether the core 110 is fully contracted, fully expanded or at any point therebetween.

In order to maintain a seal between the core 110 and the shell 160, the seal 180 should be positioned between the core 110 and the shell 160 at least at all locations where the exhaust gas can bypass the core. Preferably, the seal 180 extends continuously all the way about the core 110. That is, the seal 180 is a tube of material which is sized and shaped to fit between the core 110 and the shell 160 and of a sufficiently length to allow the seal 180 to be folded over several times, as shown in FIGS. 2–5.

A variety of well known suitable materials can be used for the seal 180, however, it is preferred that a flexible heat resistant material such as a woven ceramic cloth is used. Many commercially available ceramic cloths are suitable for the seal 180, including (but not limited to): Turbsil which is manufactured by the Mexmil Company of Santa Ana, Calif., KAO-Tex Textiles which is manufactured by Thermal Ceramics of Elkhart, Ind.

Since the ceramic cloth can withstand high temperatures, it can be directly exposed to the hot exhaust gases present in the shell 160. The type and configuration of ceramic cloth used for the seal 180 depends on the specifics of the application. For example, the greater the pressure differential in the shell 160 on either side of the core 110, the more layering (e.g. by folding) is used and/or the tighter the weave of the cloth is. The exact required properties of the cloth used can be determined by one skilled in the art using either well known analytical and/or empirical methods.

Depending on the specifics (e.g. tightness of the weave, thickness of strands, etc.) of the ceramic cloth used, a limited amount of exhaust gas may pass through a layer of seal material. However, this can be compensated for by folding the seal 110 over one or more times to prevent, or at least greatly reduce, the amount of gas passing through the folded seal 180. Likewise, less layering of the cloth can be achieved by using a tighter weave to reduce the amount of exhaust gas, which the cloth allows to pass through it.

The seal 180 can be attached to both the core 110 and the shell 160 in any of a variety of acceptable ways. These include, but are not limited to: placing spaced screws or bolts which pass through the seal 180, into the core 110 at one end and into the shell 160 at the other; holding each end of the seal 180 against the core 110 and shell 160 respectfully by strips of metal attached to the core 110 and the shell 160; and/or using a temperature resistive adhesive to bond the seal 180 to the core 110 and to the shell 160.

However, it is preferred, that folded metal bands are used to attached each end of the seal 110. As shown in FIGS. 3 and 5, a first or core attachment band 190 is attached to the sides 146 of the second end plate 144 and folded over and attached to the first end 182 of the seal 180. Likewise, a second or shell attachment band 192 is attached to the interior surface 166 of the shell 160 and folded over and attached to the second end 184 of the seal 180. The bands 190 and 192 can be of any of a variety of suitable materials, however, it is preferred that the bands 190 and 192 are a stainless steel.

To keep the seal 180 in position between the core 110 and the shell 160, and to facilitate the folding of the seal 180, a guide or retainer 194 can be used.

In an alternative embodiment of the seal 180, more than one sheet of cloth is used. That is, the seal 180 is a layering of ceramic sheets. In another alternative embodiment, more than one seal is placed along the length of the spacing 196 between the core 110 and the shell 160.

Figure 8A:
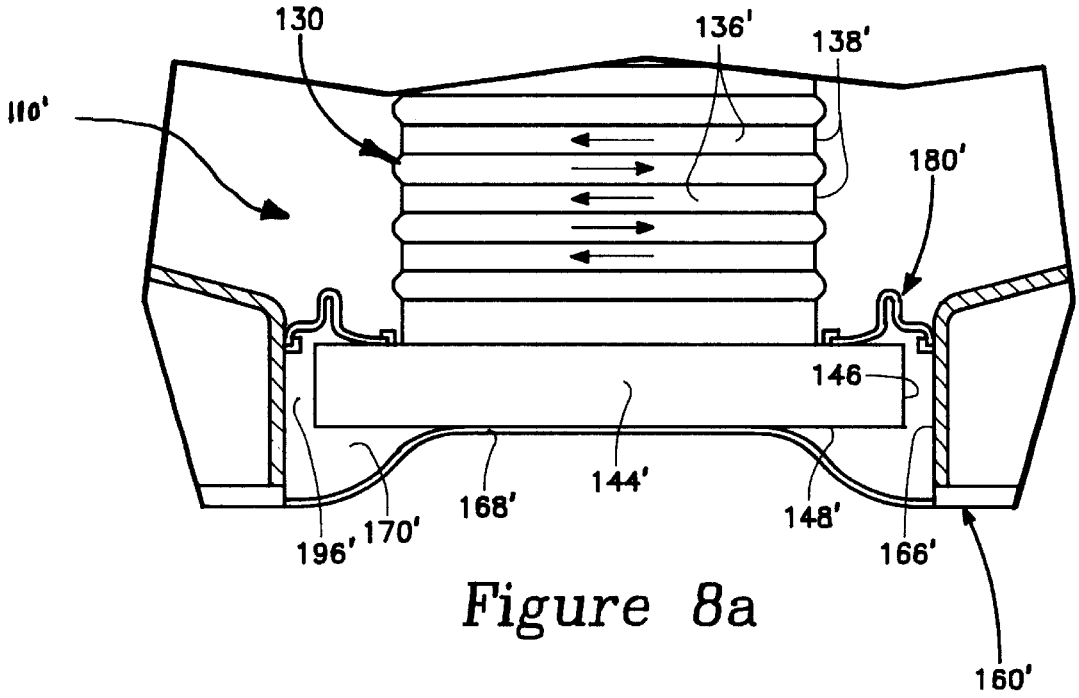
FIGS. 8*a* and *b* are side cross-sections of a heat exchanger in accordance with an embodiment of the present invention.

In at least another embodiment of the Applicants' invention, a seal 180' is positioned to extend between the core and the shell. One example of this embodiment is shown in FIGS. 8*a* and *b*. As can be seen, the seal 180' functions to allow thermal expansion of the core 110' while preventing exhaust gases from flowing around the second end plate 144' and bypassing the core 110'. The seal 180' is a single layer of material which extends from the interior surface 166' of the shell 160' across to a location near, or at, the second end plate 144' of the core 110'.

Figure 8B:
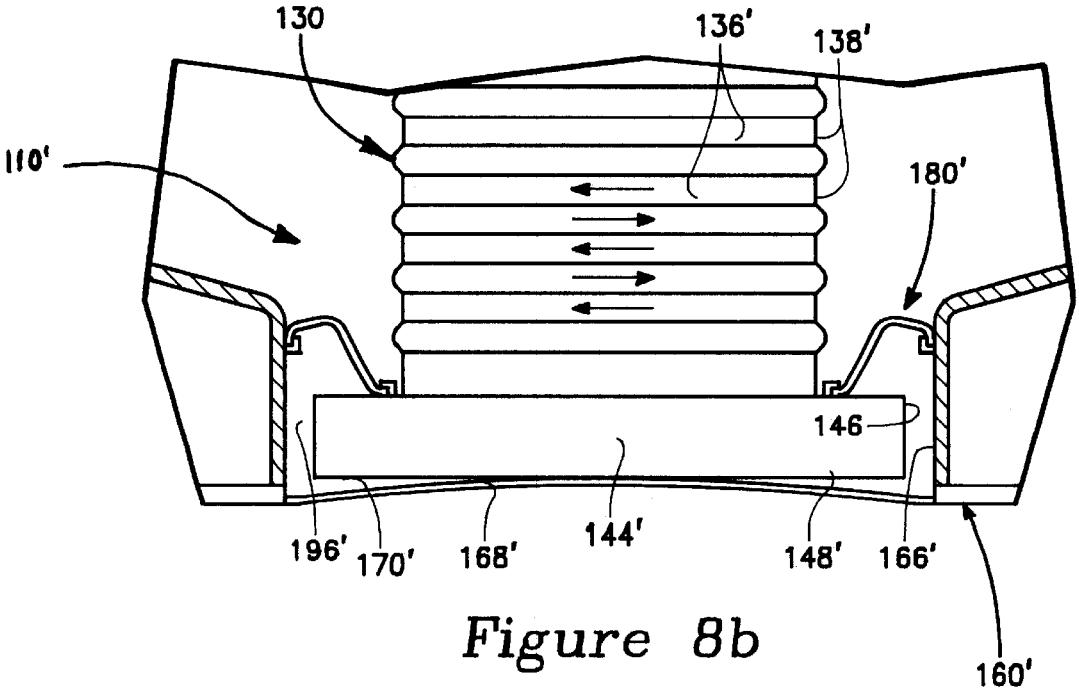

The seal 180' has sufficient additional or loose material to allow the core 110' to expand and contract as necessary. The amount of slack necessary in the seal 180' is a function of the positioning of the seal and the amount of differential expansion between the core 110' and the shell 160'. As shown in FIGS. 8*a* and *b*, the additional seal material can be folded when not needed during expansion or contraction of the core 110'. FIG. 8*a* shows the seal 180' with the core 110' contracted and FIG. 8*b* shows the seal 180' with the core 110' expanded.

The seal 180' can extend solely from the interior surface of the shell 160' to the core 110' (e.g. donut shaped), or, as is preferred, the seal 180' is a continuous sheet which runs across the core 110'. The seal 180' can be mounted at any point along the interior surface 166', however, it is preferred that the seal 180' is positioned so that it will not interfere with, or impede, the flow of the exhaust gases through the core 110'. Likewise, the seal 180' can be mounted along the core 110' at a variety of positions. Of course, to maximize heat transfer efficiency, it is preferred that the seal 180' is not attached at any location along the stack 130' which will cause the seal 180' to prevent or limit gas from entering any of the open ends 138' of the gas layers 136'. The seal 180' can be attached anywhere along the sides 146' or end 148' of the second end plate 144'. It is preferred however, that the seal 180' be a continuous sheet positioned between the stack 130' and the second end plate 144', as shown in FIGS. 8*a* and *b*.

Although the seal 180' can be any of several different suitable materials, as with the previously detailed embodiment, it is preferred that a ceramic cloth with a wire mesh is used. Specifically, it is preferred that a relatively tightly woven cloth be used so that a single layer of the cloth can completely eliminate, or sufficiently reduce, the flow of exhaust gas through the cloth.

It is preferred that when employing the seal 180' that, unlike the previous described embodiment, the second end plate 144' of the core 110' is attached to a flexible plate 168', which in turn is mounted to the shell 160'. An example of this embodiment is shown in FIGS. 8*a* and *b*. Because the plate 168' is flexible, the core 110' can expand and contract freely. Further, the plate 168' keeps the shell 160' sealed to prevent escape of any exhaust gases.

The seal 180' functions to prevent exhaust gas from bypassing the core 110' by the gas entering, and traveling around through, the space 170' set between the plate 168' and the second end plate 144'. The seal 180' also prevents the hot exhaust gases from contacting and heating the flexible plate 168'.

In an alternative embodiment, more than one sheet seal 180' can be used. The sheets can be layered on top of one another or spaced apart along the length of the spacing 196' between the core 110' and the shell 160'.

While the preferred embodiments of the present invention have been described in detail above, many changes to these embodiments may be made without departing from the true scope and teachings of the present invention. The present invention, therefore, is limited only as claimed below and the equivalents thereof.

What is claimed is:

1. A heat exchanger comprising:

a. an outer shell for containing a first gas, wherein said first gas flows through the shell;

b. an thermally expandable core for containing a second gas, wherein the core is positioned within the shell, wherein the core has a thermally contracted length and a thermally expanded length, wherein the core has a fixed end, a free end, sides, a front positioned between the sides, a back positioned between the sides, and at least one duct positioned between the front and the back through the core so that said first gas can pass through the core without mixing with said second gas, wherein the fixed end is mounted to the shell, wherein the free end is separate from the shell so that the core may expand to the expanded length without being restricted by the shell, wherein an expansion space is defined between the free end and the shell, wherein the sides abut the shell to substantially restrict flow of said gas about the core; and c. an adjustable seal positioned between the core and the shell and about the expansion space, wherein the seal substantially restricts the flow of said first gas about the free end of the core, wherein the seal is substantially contacting the core at least adjacent to the free end, and wherein the seal is sufficiently adjustable to allow the core to expand and contract while restricting the flow of said first gas past the seal, wherein the seal comprises a flexible ceramic cloth mounted at a first end to the free end of the core and mounted at a opposing second end at the shell, wherein the cloth is folded and layered between the first end and the shell to substantially prevent flow of the first gas through the seal.

2. A heat exchanger comprising:

a. an outer shell for containing a first gas, wherein said first gas flows through the shell;

b. an thermally expandable core for containing a second gas, wherein the core is positioned within the shell, wherein the core has a thermally contracted length and a thermally expanded length, wherein the core has a fixed end, a free end, sides, a front positioned between the sides, a back positioned between the sides, and at least one duct positioned between the front and the back through the core so that said first gas can pass through the core without mixing with said second gas, wherein the fixed end is mounted to the shell, wherein the free end is separate from the shell so that the core may expand to the expanded length without being restricted by the shell, wherein an expansion space is defined between the free end and the shell, wherein the sides abut the shell to substantially restrict flow of said gas about the core; and c. an adjustable seal positioned between the core and the shell and about the expansion space, wherein the seal substantially restricts the flow of said first gas about the free end of the core, wherein the seal is substantially contacting the core at least adjacent to the free end, and wherein the seal is sufficiently adjustable to allow the core to expand and contract while restricting the flow of said first gas past the seal, wherein the seal comprises a flexible ceramic cloth mounted at a first end to the core near the free end and mounted at a opposing second end at the shell, wherein the cloth has sufficient material between the first and second ends to allow the core to freely expand and contract between the thermally expanded length and a thermally contracted length.

3. A heat exchanger comprising:

a. a shell for containing a first gas, wherein said first gas flows through the shell;

b. an expandable core positioned within the shell, wherein the core has a contracted length and an expanded length, wherein the core has a fixed end and a free end, wherein the fixed end is mounted to the shell, and wherein the free end is separate from the shell so that the core may expand to the expanded length without being substantially restricted by the shell; and c. an adjustable seal positioned between the core and the shell, wherein the seal restricts the flow of said first gas past the seal, wherein the seal is substantially contacting the core at least adjacent to the free end, and wherein the seal is sufficiently adjustable to allow the core to expand and contract while restricting the flow of said first gas past the seal, wherein the adjustable seal has a first end and an opposing second end, wherein the first end is attached to the shell, wherein the second end is attached to the shell, wherein the seal has at least one fold between the first end and the second end, and wherein at least one fold abuts the core.

4. A heat exchanger comprising:

a. a shell for containing a first gas, wherein said first gas flows through the shell;

b. an expandable core positioned within the shell, wherein the core has a contracted length and an expanded length, wherein the core has a fixed end and a free end, wherein the fixed end is mounted to the shell, and wherein the free end is separate from the shell so that the core may expand to the expanded length without being substantially restricted by the shell; and c. an adjustable seal positioned between the core and the shell, wherein the seal restricts the flow of said first gas past the seal, wherein the seal is substantially contacting the core at least adjacent to the free end, and wherein the seal is sufficiently adjustable to allow the core to expand and contract while restricting the flow of said first gas past the seal, wherein the adjustable seal has a first end and an opposing second end, wherein the first end is attached to the core, wherein the second end is attached to the core, wherein the seal has at least one fold between the first end and the second end, and wherein at least one fold abuts the shell.

5. A heat exchanger comprising:

a. a shell for containing a first gas, wherein said first gas flows through the shell;

b. an expandable core positioned within the shell, wherein the core has a contracted length and an expanded length, wherein the core has a fixed end and a free end, wherein the fixed end is mounted to the shell, and wherein the free end is separate from the shell so that the core may expand to the expanded length without being substantially restricted by the shell; and c. an adjustable seal positioned between the core and the shell, wherein the seal restricts the flow of said first gas past the seal, wherein the seal is substantially contacting the core at least adjacent to the free end, and wherein the seal is sufficiently adjustable to allow the core to expand and contract while restricting the flow of said first gas past the seal, wherein the adjustable seal has a first end attached to the core, a second end attached to the shell and sufficient flexible material between the first end and the second end to allow the core to translate between the core contracted length and the core expanded length, wherein the seal has at least one fold set between the first end and the second end of the seal, wherein the at least one fold abuts at least one of the shell and the core.

6. The heat exchange of claim 5, wherein the at least one fold is at least two folds and wherein at least one fold abuts the shell and at least one fold abuts the core.

7. A heat exchanger comprising:

a. a shell for containing a first gas;

b. a core positioned within the shell; and c. at least one seal positioned between the core and the shell, wherein the at least one seal allows at least some differential expansion between the shell and the core, wherein the at least one seal restricts the flow of said first gas past the at least one seal, wherein the seal comprises at least one flexible sheet, wherein the seal comprises a first end, a second end and at least one fold positioned between the first end and the second end, and wherein the at least one fold abuts at least one of the shell and the core.

8. The heat exchanger of claim 7, wherein the at least one fold is at least two folds and wherein at least one fold abuts the shell and at least one fold abuts the core.

9. A heat exchanger comprising:

a. a shell for containing a first fluid;

b. a core positioned within the shell; and c. a ceramic cloth seal positioned between the core and the shell, wherein the ceramic cloth seal allows at least some differential expansion between the shell and the core, and wherein the ceramic cloth seal restricts the flow of the first fluid past the ceramic cloth seal.

10. The heat exchanger of claim 9, wherein the seal is a flexible sheet.

11. The heat exchanger of claim 10, wherein the seal comprises a first end, a second end and at least one fold positioned between the first end and the second end.

12. The heat exchanger of claim 11, wherein the at least one fold abuts at least one of the shell and the core.

13. The heat exchanger of claim 12, wherein the seal is folded into at least two adjacent layers.

14. The heat exchanger of claim 13, wherein the permeable seal is a ceramic cloth.

15. The heat exchanger of claim 13, wherein the permeable seal comprises a first end, a second end and at least one fold positioned between the first end and the second end, and wherein the at least one fold abuts at least one of the shell and the core.

16. The heat exchanger of claim 15, wherein the seal is folded into at least two adjacent layers.

17. A heat exchanger comprising:

a. a shell for containing a first fluid;

b. an expandable core sealed to contain a second fluid separate from the first fluid, wherein the sealed core is positioned within the shell, and wherein the core maintains sealed as the core expands; and c. a permeable seal positioned between the core and the shell, wherein the permeable seal allows the sealed core to expand, and wherein the permeable seal at least restricts the flow of the first fluid about the sealed core.

18. The heat exchanger of claim 17, wherein the ceramic cloth is woven.

* * * * *